United States Patent [19]

Kobayashi

[11] Patent Number: 4,489,945

[45] Date of Patent: Dec. 25, 1984

[54] ALL-METALLIC GOLF CLUB HEAD

[75] Inventor: Masashi Kobayashi, Matsudo, Japan

[73] Assignee: Muruman Golf Kabushiki Kaisha, Tokyo, Japan

[21] Appl. No.: 357,681

[22] Filed: Mar. 12, 1982

[30] Foreign Application Priority Data

Aug. 4, 1981 [JP] Japan ..... 56-100004[U]

[51] Int. Cl.[3] ..... A63B 53/04

[52] U.S. Cl. ..... 273/167 H; 273/172

[58] Field of Search ..... 273/167 K, 167 H, 169, 273/170, 171, 172, 80.5, 80.6

[56] References Cited

U.S. PATENT DOCUMENTS

| | | | |
|---|---|---|---|
| 1,269,745 | 6/1918 | Robertson | 273/172 |
| 1,518,316 | 12/1924 | Ellingham | 273/171 |
| 1,538,415 | 5/1925 | Tootle | 273/172 |
| 4,139,196 | 2/1979 | Riley | 273/167 H |
| 4,214,754 | 7/1980 | Zebelean | 273/167 H |
| 4,313,607 | 2/1982 | Thompson | 273/167 H |

FOREIGN PATENT DOCUMENTS

| | | | |
|---|---|---|---|
| 211781 | 1/1957 | Australia | 273/169 |
| 595117 | 1/1978 | Switzerland | 273/167 H |
| 679292 | 9/1952 | United Kingdom | 273/169 |

*Primary Examiner*—George J. Marlo

*Attorney, Agent, or Firm*—Armstrong, Nikaido, Marmelstein & Kubovcik

[57] ABSTRACT

An all metallic club head including a hollow body and a sole plate attached in a cut-out in the hollow body. The hollow body includes a front wall providing a generally flat impact face of a club head, a top wall defining a generally round upper side of the club head, a rear wall defining a back of the club head and a bottom wall providing the cut-out through which the hollow body opens downwards and a hosel extending integrally from the top wall. The front wall has a lower half which increases its thickness towards the edge of the cut-out. The sole plate is provided on its inner side with a raise extending longitudinally adjacent to the lower end of the front wall to form a weighting block on the heel side and a further weighting block on the toe side of the club head. The toe side weighting block is heavier than the heel side weighting block.

12 Claims, 9 Drawing Figures

ALL-METALLIC GOLF CLUB HEAD

BACKGROUND OF THE INVENTION

The present invention generally relates to golf clubs and more particularly, to golf drivers. Since the heads of the golf drivers are typically made of wood, they are often referred to as wood drivers or simply as woods. As can be seen in FIG. 8, the head (A') of a prior art wood driver is formed from an appropriately-shaped piece of solid wood (2'). The wood head (A') has a front face (1') to strike a golf ball and a rear side (3') behind the front face. A metallic sole plate (4') is typically secured within a cutout in the sole side of the wood head. The wood head is also provided with a plastic plate on the front face and a metal block on the rear side. Although wood drivers are used by practically all golfers, they suffer from one very significant disadvantage. Namely, in the wood drivers it has been seen that the center of gravity (G') of the club head lies at a point closer to the rear side and far above the sole side of the wood head. In consequence the sweet spot (P') of the club head which is a point on the front face at which the extension from the center of gravity (G') intersects with the tangent line (T) of the front face at a right angle is positioned high up the center of the front face as shown in FIG. 8. Ideally, to get the longer hitting distance and directioned stability of a ball, the ball must be hit at the sweet spot of the club head. In the actual play, however, most average golf players tend to hit the ball at the center of the front face of the club head. Therefore, when they hit the ball with the wood driver, they hit the ball at a location off the sweet spot of the club head. This results in inaccurate ball control and shorter hitting distance than they had expected. Of course, in the wood drivers, attempt has been made to move the center of gravity of the club head from a location in FIG. 8 to such a position that is closer to the front face and to the sole side of the head by placing a weight in the head so that the sweet spot of the club head can coincide with the center of the front face as shown in FIG. 9. However, in the wood drivers, since each wood head is formed from a different piece of solid wood of different properties and is separately shaped, such desired position of the center of gravity must be determined one by one by separately calculating both the proper quantity of the weight and the proper position of the head to which such weight is to be arranged for each wood driver. Therefore, in the conventional wood drivers, a very complicated process is required to provide a large number of wood drivers whose center of gravity are all located in such desired position as that is shown in FIG. 9.

OBJECTS AND SUMMARY OF THE INVENTION

Accordingly, an object of the present invention is to provide an improved golf driver whose center of gravity is positioned at the lower and frontal part of the club head in which the sweet spot of the club head is coincident with the center of the front face thereof. In the present invention, this object is achieved by arranging a particularly designed weighting structure on the inner wall of the club head in such a manner as defined in the claims appended to this specification.

Further object of the present invention is to provide the golf driver of the kind in which a large number of practically-identical club heads can be easily produced.

In order to accomplish this, the invention provides an all-metallic golf club head formed by casting a stainless steel in the shape of hollow substantially complete golf club head. In the preferred embodiment, this club head is formed from two parts of cast metal with a cup-shaped hollow head body as a main part and a sole plate as the second part. Once the dies, from which the hollow head body or the sole plate is cast, are completed they can be used repeatedly to produce a large number of practically-identical casts, thereby providing identically-shaped hollow head body and sole plate, respectively. After casting, the sole plate is welded in the opening or the cutout to the sole side of the cup-shaped hollow head body to form the integral complete hollow club head.

DETAILED DESCRIPTION OF PREFERRED EMBODIMENT

Figure 1:
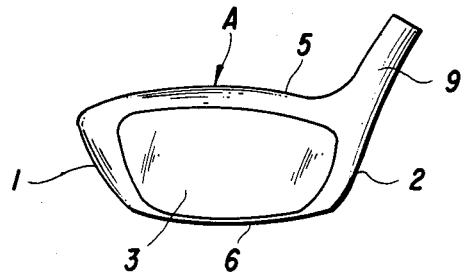
FIG. 1 is a front elevational view showing the club head body of a golf driver according to the present invention.
Figure 2:
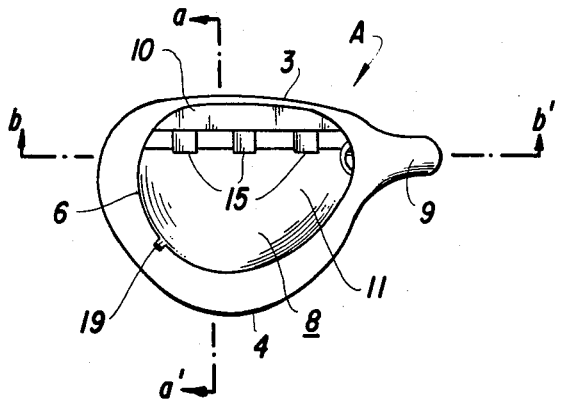
FIG. 2 is a bottom view of the FIG. 1 club head body.
Figure 3:
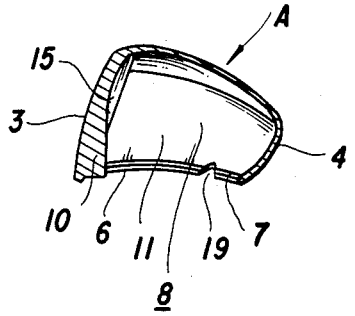
FIG. 3 is a sectional view taken in lines a—a' of the FIG. 2.
Figure 5:
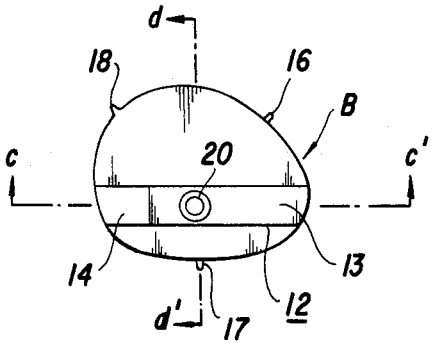
FIG. 5 is a top plan view showing the sole plate.
Figure 6:
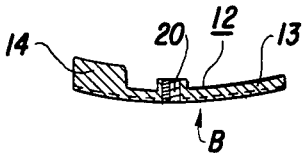
FIG. 6 is a sectional view taken in lines c—c' of the FIG. 5.
Figure 7:
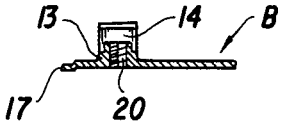
FIG. 7 is a sectional view taken in lines d—d' of the FIG. 5.

Referring now to the Figures, a perferred embodiment of the invention is illustrated. Unlike all prior golf drivers, the club head according to the invention is made of a metal body. A head body (A) which is a main part of the club head is shown in FIG. 1. A sole plate (B), which in practice is an integral part of the club head, is shown in FIG. 5 separated from the main head body (A). The head body (A) is hollow and constituted by a front wall providing a generally flat impact face of the club head, a top wall defining a generally round upper side of the club head, a rear wall defining a back of the club head, a bottom wall providing the edge of a cutout or an opening through which the hollow head body (A) opens downwards and a hosel extending integrally from the top wall. Namely, as shown in FIGS. 1 to 3, the hollow head body (A) has a toe (1), a heel (2), a front face (3) to hit a golf ball, a rear side (4) behind said front face (3), a top portion (5) and a sole or bottom side (6) providing the edge (7) of an opening or a cutout (8) through which the hollow head body (A) opens downwards. The opening or the cutout (8) in the sole side (6) of the hollow head body (A) is adapted to receive the sole plate (B) therein. The head body (A) further includes a hollow hosel (9) which extends therefrom. As is appreciated, the hosel (9) is adapted to receive the shaft of the golf driver. The head body (A), shown in FIG. 1 and the related figures, is an all-metallic hollow body formed by casting an appropriate metal, e.g., stainless steel in the desired hollow cup-shape. The sole plate (B), shown in FIG. 5 and the related figures, is also formed from cast metal, e.g., stainless steel, and is shaped to mate with the opening or the cutout (8) in the sole side (6) of the head body (A). The sole plate (B) is welded in the opening or the cutout (8) to the sole side (6) of the head body (A) to form the complete club head as shown in FIG. 9.

Figure 4:
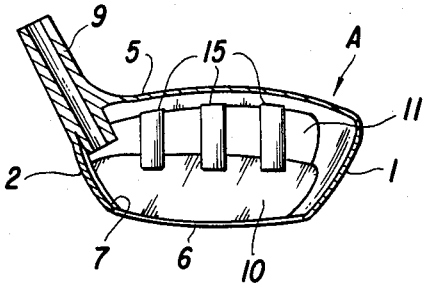
FIG. 4 is a sectional view taken in lines b—b' of the FIG. 2.
Figure 8:
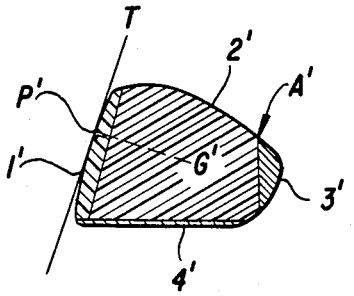
Fig. 8 PRIOR ART
FIG. 8 is a sectional view of the club head of the conventional wood golf driver.
Figure 9:
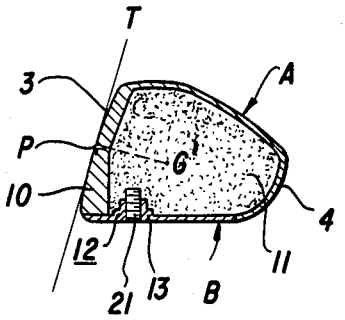
FIG. 9 is a sectional view of the club head of the present invention.

From now, detailed explanation will be made on the particularly designed weighting structure which is arranged on the inner wall of the hollow club head in order to move the center of gravity of the club head from a location (G') in FIG. 8 to such desired position (G) as shown in FIG. 9 which lies at a point much closer to the front face (3) and the sole side (6) of the club head, thereby to align the sweet spot (P) with the center of the front face (3). Referring to FIGS. 3 and 4, there is shown the first weighting portion integrally formed on the front face of the head body (A). The weighting portion of the head body (A) is formed by a thickened portion (10) extending from the toe (1) along the lower portion of the inner wall of the front face (3) toward the heel (2). At the heel (2), the end of the thickened portion (10) is positioned under the lower extension of the hosel (9) which is located inside of the hollow interior (11) of the head body (A). The thickened portion (10) protrudes inwardly from the inner wall of the front face (3) into the hollow interior (11) of the head body (A) in the slanting direction and the thickness is gradually enlarging toward its bottom side as shown in FIG. 3. The internal side of the slanted thickened portion (10) lies between the outer surface of the front face (3) and the plane passing along the axis or extension from the hosel (9). The angle constituted by the internal side of the thickened portion (10) and by the sole plate (B) is not more than 90°. Preferably, the thickened portion (10) is formed on at least the lower half of the front face (3).

In FIG. 5, there is disclosed the second weighting portion also integrally formed on the inner side of the sole plate (B). The second weighting portion of the sole plate (B) is formed by a raised portion (12) extending longitudinally thereon near the front side of the sole plate (B). The second weighting portion or the raise (12) is constituted by a weighting block (13) formed on the heel side and a further weighting block (14) formed on the toe side of the club head. The toe-side weighting block (14) is thicker than the heel-side weighting block (13) to give it more weight. FIG. 9 shows the positional relationship between the first and second weighting portions, i.e. between the thickened portion (10) of the head body (A) and the raised portion (12) of the sole plate (B) when the sole plate (B) is joined to the head body (A). As seen, the raised portion (12) of the sole plate (B) is arranged side by side with the thickened portion (10) of the head body (A) and extends longitudinally in adjacency to the lower end of the internal side of the thickened portion (10) in alignment with the axis or the extension from the hosel (9). Preferably, the thickened portion (10) and the raised portion (12) are formed by casting the same stainless steel. By forming the weighting portions (10, 13 and 14) on the internal wall of the club head in such particularly designed arrangement as described above, the center of gravity of the club head can be positioned at the lower and frontal place (G) thereof where the sweet spot (P) coincides with the center of the front fact (3) as shown in FIG. 9.

Referring again to FIG. 4, the hollow head body (A) is further integrally formed with three spaced-apart rib-like members (15) at the upper half of the inner wall of the front face (3) to increase the resistance of the front face (3) to deformation as a result of its impact with the golf ball. They are extending vertically and upwardly from the top of the thickened portion (10) to the lower surface of the top portion (5) of the head body (A).

Further, to facilitate the alignment of the sole plate (B) in the opening or the cutout (8) of the sole side (6) of the head body (A) when combining the sole plate (B) and the head body (A) together, the sole plate (B) has three lip portions (16,17 and 18) two of which (16, 17) are placed on the edge portion (7) of the sole side (6) of the head body (A) and the remaining one (18) fits in the concavity (19) formed on the edge portion (7) as shown in FIGS. 3 and 5.

The hollow head body (A) and the sole plate (B) are permanently secured to one another to form the integral hollow club head and it can be filled with a foamable plastic material therein to reduce the unaccustomed and objectionable sounds, due to the hollowness of the metal driver head as shown in FIG. 9. For this purpose, a through-hole (20) is formed on the heel-side weighting block (13) of the raised portion (12) on the sole plate (B) at the center thereof in adjacency to the toe-side weighting block (14) as shown in FIG. 5 from which a charge of the foamable plastic material is introduced into the hollow interior (11) of the hollow club head. In this case, it is preferable to use such kind of foamable plastic material that is provided with the smallest specific gravity so that it may not cause the undesired movement of the center of gravity (G) of the club head which is shown in FIG. 9. Further, to adjust the overall weight of the club head to the player's requests, lead powder can be mixed with the foamable plastic material, or a suitable weighting member can be inserted in a blind-hole in the expanded foamed plastic in the club head (A) via the through-hole (20). In this embodiment, a self-tapping screw (21) is used as such weighting member. The self-tapping screw (21) is also adapted to close the through-hole (20).

As explained so far, in the present invention, the club head's weight is concentrated in the face and sole sides thereof as a result of the particularly designed weighting structure formed on the inner wall of the front face (3) of the head body (A) and of the sole plate (B). By such weight distribution, the center of gravity of the club head is positioned at a location (G) much closer to the front face and to the sole side thereof where the sweet spot (P) can coincide with the center of the front face of the club head as shown in FIG. 9. Additionally, in accordance with the present invention, since the club head is formed from two parts of cast metal, a large number of practically-identical club head can be easily produced at low cost.

What is claimed is:

1. An all-metallic golf club head comprising a hollow body formed of cast metal and ;including a front wall providing a generally flat impact face of the club head, a top wall defining a generally round upper side of the clup head, a rear wall defining a back of the club head, a bottom wall providing the edge of a cutout through which said hollow body opens downwards and a hosel extending integrally from said top wall at the heel side of the club head, a lower part of said hosel extending downwardly into said hollow body toward said bottom wall, wherein said front wall the lower half of which increases its thickness toward said edge of said cutout, and the heel end of said lower half of said front wall lies under said lower part of said hosel, and a sole plate formed of cast metal and attached in said cutout in close conformity with the configuration of said cutout of said hollow body and provided on its inner, forward side thereof with a raised portion extending longitudinally adjacent to the lower end of said front wall to form a weighting block on the heel side and a further weighting block on the toe side of the club head, wherein said toe-side weighting block is heavier than said heel-side weighting block wherein the increase in thickness of the lower half of said front wall moves a center of gravity of said club head towards the front wall and the bottom wall, the raised portion of the sole plate also moves the center of gravity towards the front wall and the bottom wall, a balance of weight between the toe side weighting block and the heel side weighting block moves the center of gravity to be approximately midway between the toe and the heel of the club head, the extension of the lower part of the hosel into the hollow body moves the center of gravity towards the bottom wall, whereby a sweet spot of the club coincides with the center of the front face of the club head.

2. A golf club head according to claim 1, wherein the angle constituted by the internal side of said lower half of said front wall of said hollow body and by said sole plate is not more than 90°.

3. A golf club head according to claim 2, wherein said hollow club head is filled with a foamable plastic material therein.

4. A golf club head according to claim 3, wherein said raised portion of said sole plate is formed with a through-hole from which a charge of said foamable plastic material is introduced into the hollow interior of said hollow club head.

5. A golf club head according to claim 4, wherein said through-hole is formed on said heel-side weighting block adjacent to said toe-side weighting block.

6. A golf club head according to claim 5, wherein a self-tapping screw is inserted in the expanded foamed plastic material within said hollow club head through said through-hole.

7. A golf club head according to claim 3, wherein lead powder is mixed with said foamable plastic material.

8. A golf club head according to claim 4, wherein said hollow body and said sole plate are formed from stainless steel.

9. A golf club head according to claim 1, wherein said hollow body is further integrally formed on its inner side with spaced-apart ribs at the upper half of said front wall which extend vertically and upwardly from the top of said lower half of said front wall up to the lower surface of said top wall.

10. A golf club head according to claim 9, wherein said internal side of said lower half of said front wall lies between the outer surface of said front wall and an extension from said hosel and said raised portion on said sole plate is positioned in alignment with said extension from said hosel.

11. A golf club head according to claim 11, wherein said hollow body is further formed with a recess at the edge of said cutout of said bottom wall and said sole plate is formed at its outer edge with a projection which is adapted to engage with said recess of said body when said sole plate is attached to said body.

12. A golf club head according to claim 11, wherein said sole plate is formed with another projection on its outer edge which is used to engage with the edge of said cutout of said bottom wall of said hollow body when said sole plate is attached to said body.

* * * * *